US007812244B2

(12) United States Patent
Kotton et al.

(10) Patent No.: US 7,812,244 B2
(45) Date of Patent: Oct. 12, 2010

(54) METHOD AND SYSTEM FOR REPRODUCING SOUND AND PRODUCING SYNTHESIZER CONTROL DATA FROM DATA COLLECTED BY SENSORS COUPLED TO A STRING INSTRUMENT

(76) Inventors: Gil Kotton, 2 Amal St., 53327 Givatayim (IL); Ilan Lewin, 40 Chen Blvd., 76469 Rehovot (IL); Yehuda Kotton, 19 Sde Boker St., 53465 Givatayim (IL)

( * ) Notice: Subject to any disclaimer, the term of this patent is extended or adjusted under 35 U.S.C. 154(b) by 85 days.

(21) Appl. No.: 12/092,077

(22) PCT Filed: Nov. 14, 2006

(86) PCT No.: PCT/IL2006/001310

§ 371 (c)(1),
(2), (4) Date: Apr. 29, 2008

(87) PCT Pub. No.: WO2007/054948

PCT Pub. Date: May 18, 2007

(65) Prior Publication Data

US 2008/0282873 A1 Nov. 20, 2008

(51) Int. Cl.
*G10H 1/18* (2006.01)

(52) U.S. Cl. ..... 84/724; 84/722; 84/723; 84/615

(58) Field of Classification Search ..... 84/722–724, 84/726, 730, 731, 615, 639, 645, 646, 653, 84/678
See application file for complete search history.

(56) References Cited

U.S. PATENT DOCUMENTS 3,217,079 A * 11/1965 Murrell ..... 84/722
3,482,029 A * 12/1969 Sines ..... 84/722
3,530,227 A * 9/1970 Terlinde et al. ..... 84/722
3,662,641 A * 5/1972 Allen et al. ..... 84/722
3,699,492 A * 10/1972 Yoshihara ..... 338/69
3,733,953 A * 5/1973 Ferber ..... 84/724
4,028,977 A * 6/1977 Ryeczek ..... 84/724
4,339,979 A * 7/1982 Norman ..... 84/627
4,430,918 A 2/1984 Meno
4,468,997 A * 9/1984 Young, Jr. ..... 84/722
4,468,999 A * 9/1984 Bonanno ..... 84/687
4,563,931 A * 1/1986 Siebeneiker et al. ..... 84/724
4,580,479 A * 4/1986 Bonanno ..... 84/626
4,630,520 A * 12/1986 Bonanno ..... 84/655
4,653,376 A * 3/1987 Allured et al. ..... 84/646
4,688,460 A * 8/1987 McCoy ..... 84/724
4,702,141 A * 10/1987 Bonanno ..... 84/626
4,723,468 A * 2/1988 Takabayashi et al. ..... 84/722

(Continued)

*Primary Examiner*—David S. Warren
(74) *Attorney, Agent, or Firm*—The Law Office of Michael E. Kondoudis

(57) ABSTRACT

A method and system for producing synthesizer and MIDI control data and for reconstructing and reproducing a signal from data collected by sensors coupled to a string instrument comprising a plurality of sensors coupled to the string instrument and a control unit that is associated with the plurality of sensors. The sensors are adapted to collect temporal and spatial data referring to performer's actions and to the sound generation process of the string instrument, specifically as to string deflection along time, while the control unit is adapted to process the data and generate a signal corresponding to the sound characteristics of the performer's playing and actions on the string instrument.

17 Claims, 3 Drawing Sheets

U.S. PATENT DOCUMENTS 4,730,530 A * 3/1988 Bonanno ..... 84/724
4,748,887 A * 6/1988 Marshall ..... 84/646
4,760,767 A * 8/1988 Tsurubuchi ..... 84/646
4,794,838 A * 1/1989 Corrigau, III ..... 84/600
4,812,635 A * 3/1989 Kaufmann et al. ..... 356/621
4,815,353 A * 3/1989 Christian ..... 84/724
4,858,509 A * 8/1989 Marshall ..... 84/646
4,919,031 A * 4/1990 Matsumoto ..... 84/601
4,928,563 A * 5/1990 Murata et al. ..... 84/726
4,947,726 A * 8/1990 Takabayashi ..... 84/743
4,951,546 A * 8/1990 Takabayashi et al. ..... 84/718
4,977,813 A * 12/1990 Norimatsu ..... 84/722
5,010,800 A * 4/1991 Yoshida ..... 84/646
5,012,086 A * 4/1991 Barnard ..... 250/222.1
5,025,703 A * 6/1991 Iba et al. ..... 84/718
5,065,659 A * 11/1991 Uchiyama et al. ..... 84/723
5,085,120 A * 2/1992 Ishiguro ..... 84/737
5,094,137 A * 3/1992 Matsumoto ..... 84/615
5,113,742 A * 5/1992 Matsumoto ..... 84/615
5,121,669 A * 6/1992 Iba et al. ..... 84/735
5,153,364 A * 10/1992 Uchiyama et al. ..... 84/742
5,189,240 A * 2/1993 Kawashima ..... 84/724
5,214,232 A * 5/1993 Iijima et al. ..... 84/724
5,237,126 A * 8/1993 Curtis et al. ..... 84/724
5,488,196 A * 1/1996 Zimmerman et al. ..... 84/612
5,567,902 A * 10/1996 Kimble et al. ..... 84/658
5,619,004 A 4/1997 Dame
5,913,260 A * 6/1999 Buchla ..... 84/724
5,922,984 A * 7/1999 Paterlini ..... 84/669
5,929,360 A 7/1999 Szalay
5,998,727 A * 12/1999 Toba et al. ..... 84/724
6,153,822 A * 11/2000 Toba et al. ..... 84/724
6,162,981 A 12/2000 Newcomer et al.
6,191,350 B1 * 2/2001 Okulov et al. ..... 84/646
6,225,544 B1 * 5/2001 Sciortino ..... 84/464 A
6,392,137 B1 * 5/2002 Isvan ..... 84/726
6,501,012 B1 * 12/2002 Toba et al. ..... 84/724
6,809,249 B2 * 10/2004 Stuebner et al. ..... 84/738
6,846,980 B2 * 1/2005 Okulov ..... 84/646
6,888,057 B2 * 5/2005 Juszkiewicz et al. ..... 84/645
7,060,887 B2 * 6/2006 Pangrle ..... 84/724
7,087,828 B2 * 8/2006 Krieger ..... 84/454
7,129,468 B2 * 10/2006 Ennes ..... 250/221
7,271,328 B2 * 9/2007 Pangrle ..... 84/464 R
7,285,714 B2 * 10/2007 Juszkiewicz et al. ..... 84/726
7,399,918 B2 * 7/2008 Juszkiewicz et al. ..... 84/742
7,446,253 B2 * 11/2008 Knapp et al. ..... 84/722
7,501,570 B2 * 3/2009 Shibata ..... 84/723
2002/0148346 A1 * 10/2002 Okulov ..... 84/613
2003/0005816 A1 * 1/2003 Stuebner et al. ..... 84/738
2004/0065188 A1 * 4/2004 Stuebner et al. ..... 84/723
2005/0183567 A1 * 8/2005 Aoki et al. ..... 84/722
2006/0107826 A1 * 5/2006 Knapp et al. ..... 84/724
2007/0256551 A1 * 11/2007 Knapp et al. ..... 84/722
2008/0141847 A1 * 6/2008 Komatsu et al. ..... 84/440
2009/0314157 A1 * 12/2009 Sullivan ..... 84/646

* cited by examiner

PRIOR ART

METHOD AND SYSTEM FOR REPRODUCING SOUND AND PRODUCING SYNTHESIZER CONTROL DATA FROM DATA COLLECTED BY SENSORS COUPLED TO A STRING INSTRUMENT

REFERENCES CITED

| References Cited | | |
|---|---|---|
| 4,430,918 | February 1984 | Meno |
| 4,468,997 | September 1984 | Young, Jr. |
| 4,815,353 | March 1989 | Christian |
| 4,947,726 | August 1990 | Takabayashi |
| 5,619,004 | April 1997 | Dame |
| 5,929,360 | July 1999 | Szalay |
| 4,730,530 | March 1998 | Bonanno |
| 6,392,137 | May 2002 | Isvan |
| 20060107826 | May 2006 | Knapp |

FIELD OF THE INVENTION

The present invention relates generally to reproducing a sound signal and producing synthesizer and MIDI control data from string instruments and more particularly to a method and a system for reconstructing a sound signal and producing synthesizer and MIDI control data from data collected by sensors coupled to a string instrument.

BACKGROUND OF THE PRIOR ART

String instruments generate sound by means of vibrating strings, the strings acting as resonators in a process of converting mechanical movements into sound signals. A string at a certain length and tension may generate only a single note at a time and the sound generated by the string is determined by combination of the physical characteristics of the string and several parameters set dynamically by the performer in the process of playing the instrument. The parameters set by the performer are primarily the length of the string, determining the pitch of the sound signal. This is usually done through the selection of a certain fret on the fret-board. However, there are many more parameters such as the intensity, position and style of plucking the string, as well as other sound production methods such as striking, hammering, bending, sliding etc.

In processing of a string instrument, it is often desirable to have the ability to operate and control a synthesizer from any common string instrument. Exemplary systems dedicated for guitars are often referred to as guitar-synthesizers or midi-guitars.

Currently, the process of converting the instrument playing process on a string instrument into synthesizer control messages such as MIDI is usually achieved by pitch detection techniques. Pitch detection (such as Dame, 1997) is a method in which the output signal of a string instrument is processed and the base frequency is detected using a variety of Digital Signal Processing (DSP) techniques. After the base frequency has been detected, a control signal is conveyed to a synthesizer, which produces the desired sound.

The main drawback of pitch detection is a persistent and inevitable delay between sound generation on the guitar and frequency determination and the consequent synthesizer sound generation. This delay is inherent to all DSP techniques and is disruptive for musical performance. This delay is related to the wavelength of the sound, and is not due to the lack of computing power. It is also due to the fact that the initial period after a sound is generated (the "attack") is a transient stage in which string motion is not yet a clean harmonic motion. One method to try to solve this problem involves timing the spacing of plucking transient pulses (Szalay, 1999). This method is still limited by the time delay caused by the propagation of the pulses along the string.

Other attempts to solve these problems are by directly determining the desired note by establishing an electrical connection to each fret in order to determine the selected fret (Young 1984, Meno 1984), by placing push-buttons under frets, or by the transmission of ultra-sound frequency sound along the string and by timing echoes, determining the selected frets (Takabayashi, 1990). These methods where abandoned with time due to various implementation, installation and performance issues.

It would be desirable therefore to have a method and system dedicated to string instruments that allows the conversion of playing on a string instrument into control signals such as MIDI, without any perceptible delays and with minimal alterations of the musical instrument.

Another aspect of string instruments is the use of pickups. Most string instruments can be fitted with pickups to convert the string's vibrations into an electrical signal which is amplified and then converted back into sound by loudspeakers. The conversion of the sound into a corresponding electrical signal also enables the recording of the sound produced as well as signal processing. Pickups for string instruments are well known in the art and usually involve electromagnetic, piezoelectric, or optical conversion principals.

One drawback of the use of electromagnetic pickups is their ability to detect only string movement and not the absolute position of a string, nor the resting position of a string. Another problem arising mainly in magnetic pickups is that due to the nature of this technique it is limited to metallic strings and sometimes the magnetic sensors are prone to crosstalk interference. Another drawback of the electromagnetic pickup is its susceptibility to external magnetic/electric field interference. Another drawback of the electromagnetic pickup is its limited frequency range which causes loss of some of the sound energy and information produced on the guitar. Optical pickups are susceptible to ambient lighting conditions, often necessitating cumbersome coverings that hinder playing and are limited to near bridge placement, where string dynamics are minimal.

Therefore, it would be further desirable to have a method and a system that enables reconstructing and reproducing the sound of a string instrument and that the conversion process from mechanical movements to an electrical signal will be of high fidelity and not prone to external interferences.

SUMMARY OF SOME EMBODIMENTS OF THE INVENTION

The present invention seeks to solve the above-mentioned problems of delays as well as inaccuracies in producing control data and audio signal from string instruments and provides a novel method and system for producing synthesizer and MIDI control data in real time and reconstructing and reproducing an accurate sound signal in real-time from data collected by sensors coupled to the instrument.

Specifically, the system for producing synthesizer and MIDI control data and for reconstructing and reproducing a signal from data collected by sensors coupled to a string instrument comprises at least one sensor coupled to the string instrument and a control unit that is associated to said at least one sensor. The sensor is adapted to collect temporal and spatial data referring to playing information and the sound generation process of the string instrument and the control unit is adapted to process the data and generate a signal corresponding to the sound characteristics of the performers playing the string instrument and corresponding to the performer's actions on the string instrument. The signal produced may be either a control signal for synthesizers and the like, such as MIDI control data or an audio signal representing the sound produced on the string instrument.

The present invention comprises the collection of data by sensors, wherein the data relates to the physical position of the strings of the string instrument and specifically, the string spatial deflection.

The present invention further seeks to improve the means of controlling electronic music devices controlled by MIDI or by other communication protocols (e.g. synthesizers, sequencers, drum machines, lighting, computers and gaming consoles) through the use of string instruments. Specifically, the present invention allows performers of string instruments to operate and control synthesizers through the use of their standard stringed musical instruments, using the sensors according to the invention as input devices.

In embodiments of the invention, at least one of the physical position related data is detected in real-time at any time, including times in which there is no vibration of the string. Thus, data is collected before, during and after a sound is actually generated, or when a performer makes movements that do not result in produced sound. Through data analysis and processing, this process allows a very accurate prediction of the desired note to be played. The conversion of a string instrument's player's actions into synthesizer control information is performed according to the invention with no delay, or with delay that is shorter than perceived by humans.

In embodiments of the invention, one of the physical position related data collected by the sensors is the absolute deflection of a string from its resting position on the axis that is perpendicular to the plane of the fret-board surface. This deflection, when collected in real time, may be used to determine the exact location along a string where the performer has pressed it to a certain fret. Because there is a deterministic relation between the fret onto which the string was depressed and the above mentioned deflection of the string, the desired fret and subsequently the desired note may be determined. This information, in turn is used to produce the MIDI or any similar control data. Moreover, data regarding the string deflection may be collected both when the string is at rest and when the string is vibrating.

In embodiments of the invention, another physical position related data collected by the sensors is the absolute deflection of a string from its resting position on the axis that is the parallel to the plane of the fret-board surface and perpendicular to the string longitude axis. This deflection, when collected in real time, may be used to determine the amount of bend (sideways deflection) applied to a string and the extent and velocity of note initiation. This information, in turn, is used to produce the MIDI or similar control data. Moreover, data regarding the string deflection may be collected both when the string is at rest and when the string is vibrating.

In embodiments of the invention data collection by the sensors will be performed continuously (after, during and mainly before sound is actually generated by the instrument), allowing for most or all of the processing based on string deflection to take place before the sound is played on the stringed instrument, making the device virtually real-time and reducing the delay between the performer's playing and the generation of a control data or audio signal by the system.

In embodiments of the invention means of prediction are used in order to determine fretting position, picking position and the exact timing of the picking or other note initiation for the generation of an output control data before and while the sound is played. This, contrarily to techniques already known in the art such as pitch detection, where the waveform output from the string instrument is analyzed after the sound has been actually produced. However, the present invention allows the incorporation of pitch detection techniques, to verify the detection process, and for error checking, feedback and calibration.

In embodiments of the invention, special playing techniques may also be detected. These techniques may include, but are not limited to: hammering, slapping, slides, bends, string damping, finger vibrato, muting, harmonics and the like. Additionally, different types of note initiation may also be detected, such as: using a pick or finger, popping, slapping, strumming, picking velocities and patterns etc.

In embodiments of the invention, a technique of initiating notes by fretting and ending notes by releasing the fretting is detected.

In embodiments of the present invention means of connection to sound synthesizers are provided. An external synthesizer may be controlled through MIDI or other communication protocols, an internal synthesizer module can be used, and other external MIDI controlled devices may be addressed, (such as sequencers, drum-machines, MIDI-controlled lighting elements and the like). Furthermore, a computer may be addressed for the purposes of calibration, sound synthesis, recording, mixing and the like, via standard communication interfaces (USB, MIDI etc.).

Similarly, the system may be connected to any computer or gaming console for the purpose of serving as a game controller and gaming consoles may be addressed by the control data generated by the system.

In embodiments, the system may be connected to any computer or gaming console for the purpose of serving as a game controller. In addition, the system may be itself controlled through MIDI or other means of communication, for the purposes of calibration, real time parameter control and the like.

Other aspects of the present invention are methods for automatic or semi-automatic off-line calibration of the system, and for the acquisition of critical information. Such calibration methods perform an exact mapping of the characteristics of the specific instrument, and determine optimal data collection by the sensors parameters for real-time, these allow for the real-time algorithms to be more efficient.

BRIEF DESCRIPTION OF DRAWINGS

The subject matter regarded as the invention will become more clearly understood in light of the ensuing description of embodiments herein, given by way of example and for purposes of illustrative discussion of the present invention only, with reference to the accompanying drawings, wherein.

Figure 1:
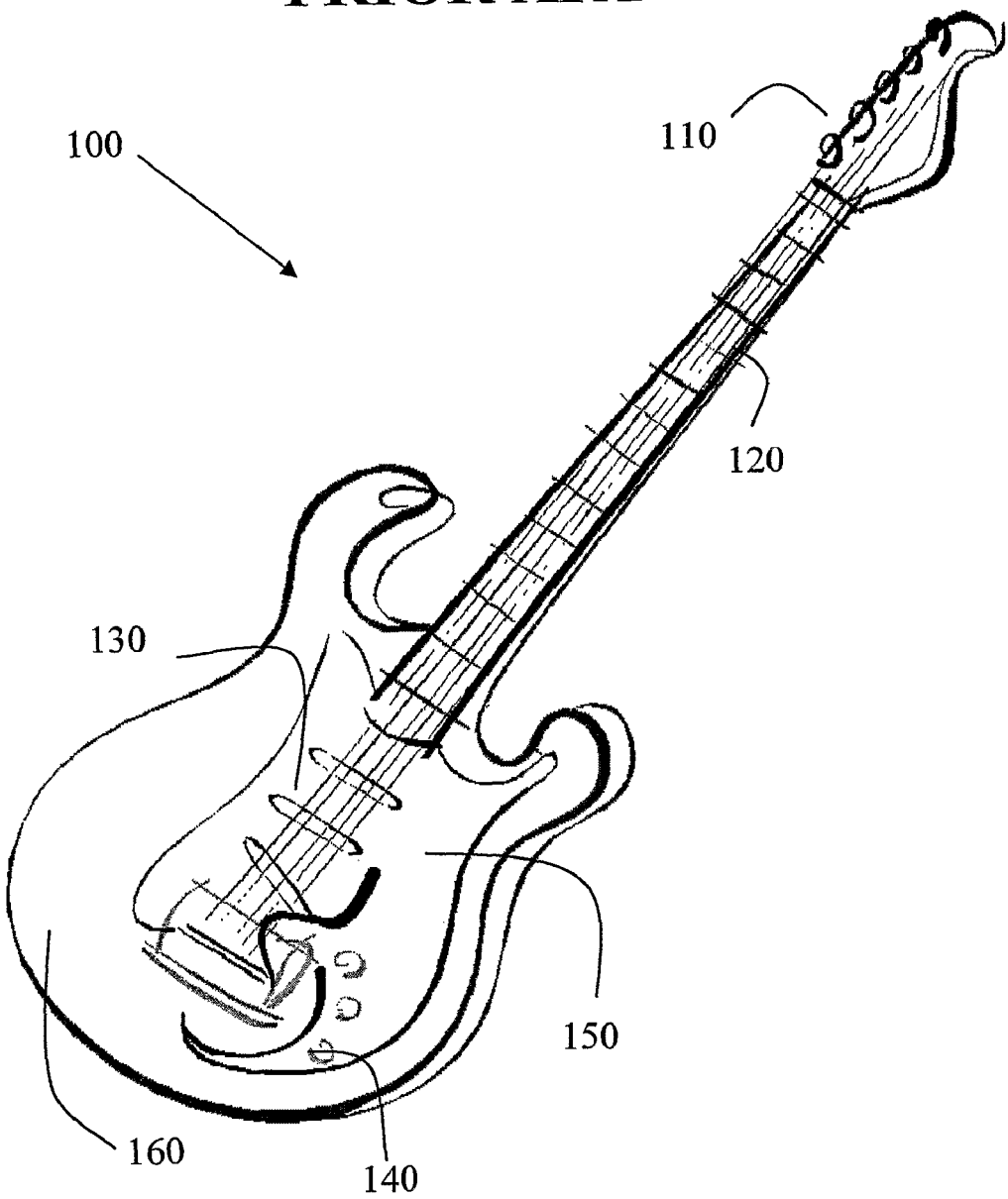
FIG. 1 is an illustration of a guitar showing the parts relevant to the sound generation process.

The drawings together with the description make apparent to those skilled in the art how the invention may be embodied in practice.

No attempt is made to show structural details of the invention in more detail than is necessary for a fundamental understanding of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF SOME EMBODIMENTS OF THE INVENTION

An embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiments, but not necessarily all embodiments, of the inventions.

It is understood that the phraseology and terminology employed herein is not to be construed as limiting and are for descriptive purpose only. The principles and uses of the teachings of the present invention may be better understood with reference to the accompanying description, figures and examples. It is to be understood that the details set forth herein do not construe a limitation to an application of the invention.

Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, or integers or groups thereof and that the terms are to be construed as specifying components, features, steps or integers.

The phrase "consisting essentially of", and grammatical variants thereof, when used herein is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described. Methods of the present invention may be implemented by performing or completing manually, automatically, or a combination thereof, selected steps or tasks.

The term "method" refers to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only. Meanings of technical and scientific terms used herein are to be commonly understood as by one of ordinary skill in the art to which the invention belongs, unless otherwise defined.

The present invention can be implemented in the testing or practice with methods and materials equivalent or similar to those described herein.

The terms "bottom", "below", "top" and "above" as used herein do not necessarily indicate that a "bottom" component is below a "top" component or that a component that is "below" is indeed "below" another component or that a component that is "above" is indeed "above" another component. As such, directions, components or both may be flipped, rotated, moved in space, placed in a diagonal orientation or position, placed horizontally or vertically or similarly modified. Accordingly, it will be appreciated that the terms "bottom", "below", "top" and "above" may be used herein for exemplary purposes only, to illustrate the relative positioning or placement of certain components, to indicate a first and a second component or to do both.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

In the following description special terminology has been used and the following definitions shall apply:

Vertical string deflection—any deflection of a string along an axis that is perpendicular to the plane of the fret-board surface.

Horizontal string deflection—any string deflection along an axis that is parallel to the plane of the fret-board surface and perpendicular to the string longitude axis.

When string deflection is indicated without specifically addressing either vertical string deflection or horizontal string deflection, it should be understood as pertaining to either or both The method hereby disclosed is a method for producing a signal from data collected by one or more sensors coupled to a string instrument. The method starts with detecting in real time the string deflection of one or more strings of the string instrument. Then, the string deflection is analyzed in accordance with string state calibration and predefined parameters to determine the performer's actions. This is whereas at least some of the analysis takes place before a sound is actually generated on the string instrument. Finally, a signal representing sound characteristics of the performer's playing in accordance with said analysis is produced.

The system hereby disclosed comprises at least one sensor that may be in the form of, but not limited to, photo-sensitive cell arrays. These sensors are adapted to detect and measure spatial and temporal information relating to the sound production process in a string instrument. Specifically, the sensors are adapted to detect and measure string deflection.

According to some embodiments of the invention, each sensor comprises a plurality of photo-sensitive cells each representing a single pixel. The cells may be lined up to form a one-dimensional cell array. Alternatively the cells may take the form of a two-dimensional matrix, cluster or any two-dimensional cell array. The cells may be fitted into an opaque housing with a slit or a pin-hole like aperture in the housing. The cells may be implemented in CMOS (Charge Coupled Device) technology, CCD (Complementary Metal Oxide Silicon) technology, photodiodes array or any other suitable technology. The photo sensitive cells are not limited to visible light, but rather, they may operate with any wavelength that corresponds to the lighting means used in the specific implementation of the present invention.

According to other embodiments of the invention, non optical sensors may also be used, for example: Hall-effect sensors, piezo-electric sensors and electromagnetic sensors.

The information gathered by the sensors is delivered to a control unit which in turn, analyzes and processes the information into at least one of the signals: an audio signal that represents the sound signal that is being produced in real-time to be delivered to an amplifier and sound speakers, and a control data signal corresponding to the performer's actions for the purpose of guitar to synthesizer conversion, this control data signal to be delivered to synthesizers and the like.

According to some embodiments of the invention, the control signal generated by the control unit is in the form of a MIDI message. However, other control protocols may be used as well. The control signal enables controlling synthesizers, sequencers, drum machines, lighting, computers, gaming consoles and the like.

The remainder of the description is dedicated for one exemplary string instrument—the guitar. It will be clear to a person having ordinary skills in the art that a similar method and system may be operative with any other kind of a string instrument.

Reference is now made to FIG. 1 which is a simplified pictorial illustration of a guitar 100 showing all relevant parts and areas of a standard string instrument, as follows: headstock 110, fret-board 120, picking area 130, control knobs 140, free areas 150, 160.

Figure 2:
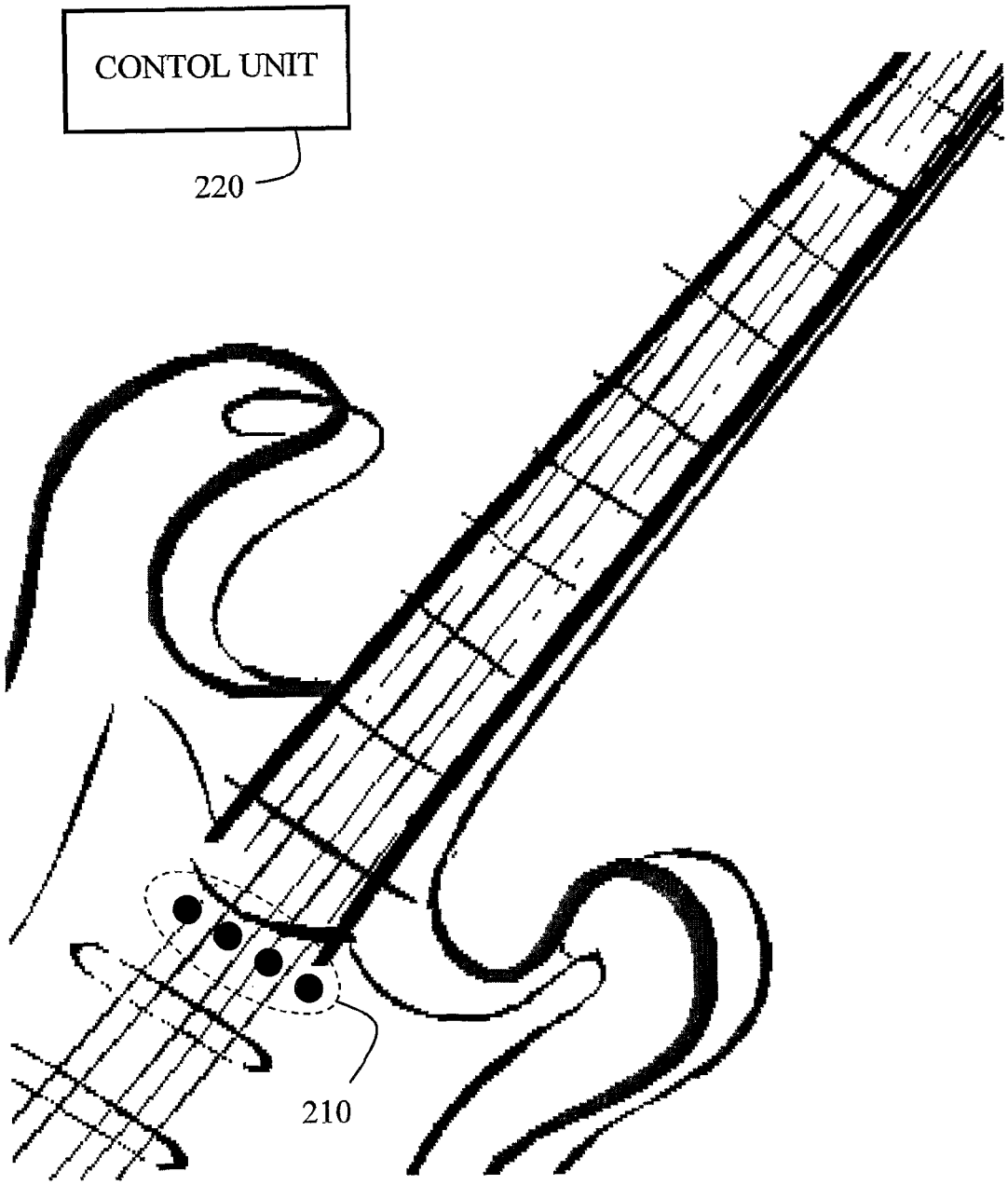
FIG. 2 is an illustration showing sensors at a possible position on a guitar.

Turning now to FIG. 2, an illustration of a guitar is presented with the system according to the present invention. The system comprising a single sensor or a plurality of sensors mounted below the strings and directed to the string as indicated in location 210. These sensors are associated with a control unit 220 via means of communication (not shown) constructed and operative in accordance with some embodiments of the present invention. Possible locations may be inside the standard pickup cavities, or inside special cavities in the guitar body. Further possible locations may be directly under the strings while mounted to the surface of the guitar, or above the strings at some position along the strings.

According to some embodiments of the invention the sensors are fitted below the strings in location 210 and are adapted to detect the physical position and specifically the string deflection of each and every string. The exact absolute string deflection may be extracted from this data. These deflections are traced over time, creating a full temporal and spatial representation of the sound characteristics.

According to some embodiments of the invention, the data regarding string deflection is stored over time on dedicated buffer storage in the control unit 220 wherein the buffer storage is adapted to hold data for a predefined period playing time. The data stored is used by the control unit 220 to provide a fuller and more accurate representation of the performer's actions in the process of playing the string instrument. This is due to the fact that current sound production is a function of both actions performed in real-time and actions that have been preformed prior to the real-time actions.

According to one embodiment of the invention, the sensors are mounted into an enclosure which resembles a standard pickup enclosure, and is mounted onto the guitar in a manner similar to that of a standard pickup. The sensor enclosure is placed beneath the strings at a point where a standard pickup cavity is positioned in a guitar. In this embodiment, the sensors face upwards towards the strings. An illuminating system (such as LED lighting) is placed adjacent to the sensor and also faces the strings. In this manner, the illuminating system illuminates the strings; light reflected from the strings is projected backwards onto the sensors. The self illumination may be in any wavelength, narrow band, infrared (IR) light, polarized light, modulated light etc.

According to other embodiments of the current invention, the sensors and lighting system are placed beneath the strings, but on top of the guitar surface, in a manner that does not require any assembly or disassembly of the guitar in order to install the system.

According to some embodiments of the invention, the fretting position may be determined by detecting the string parameters such as the height of a string relative to its height at rest while not fretted (during calibration) and the string angle relative to its angle at rest. This can be done for each of the strings separately. Specifically, the height is derived from the vertical string deflection whereas the angle is derived from both the horizontal and vertical string deflections.

Figure 3:
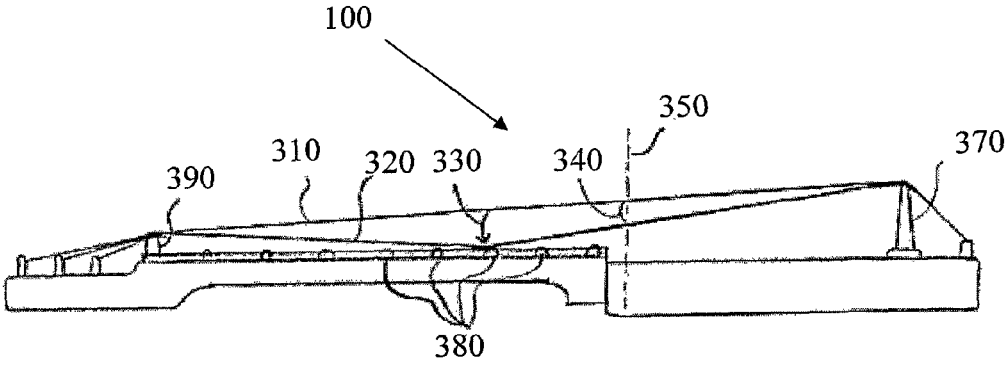
FIG. 3 is an illustration showing a deflection of a string on the axis that is perpendicular to the plane of the fret-board surface in comparison to its static position at rest.

Turning now to FIG. 3 an example for determining the fretting position on a string is provided. FIG. 3 is a side view showing a guitar 100 with a string 310 suspended between the nut 390 and the bridge 370. As the string 310 is pushed down in a specific location such as 330 towards the frets 380, the string reaches a new position 320. The string is correspondingly displaced downwards 340, as seen on an axis that is perpendicular to the plane of the fret-board surface, for example axis 350. This displacement is the vertical string deflection. For every discrete fretting (pushing of a string down to a fret) on the fret-board 120 there is a discrete corresponding downwards displacement 340 of the string 310, 320 as seen on axis 350. By measuring this downwards displacement 340, it is possible to calculate at which of the corresponding frets 380 the string 310, 320 was pushed down, thus determining fretting position on the string 310, 320.

According to some embodiments of the invention, both vertical string deflection as well as the horizontal string deflection may be measured by the sensors in location 210. The string deflection referred to is the difference between the position of the string at rest (at its nominal position when not touched by the performer) and the position of the string while it is being pressed by the performer. In case of vertical string deflection, the measured difference may be used to determine fretting position, being the point along the string where the performer presses the string to the fret. In case of horizontal string deflection, the measured difference may be used to determine the extent to which the performer bends a string or displaces a string during picking.

Figure 4:
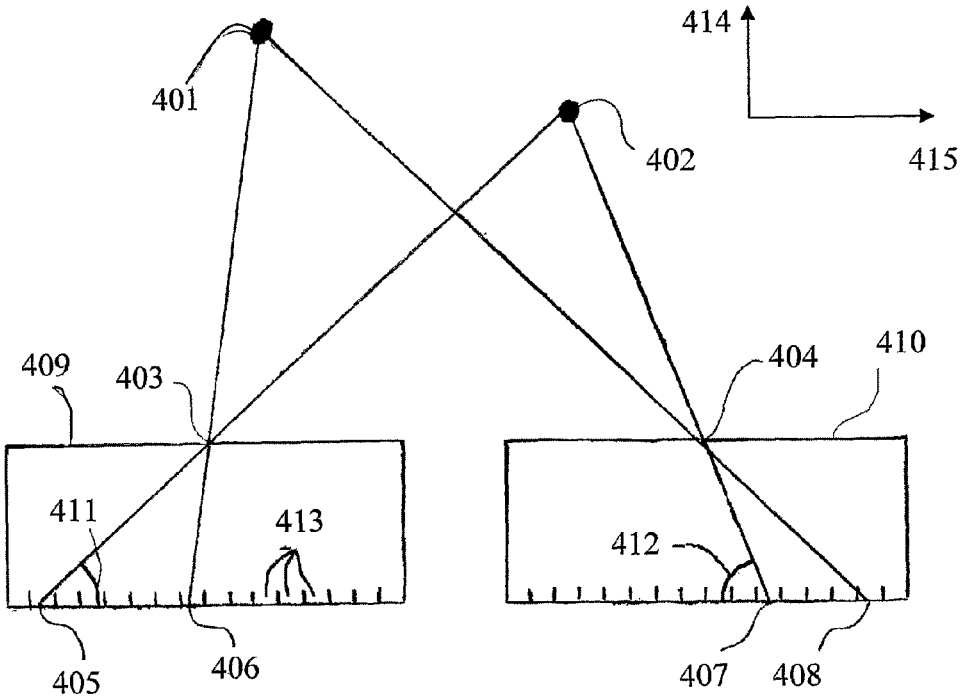
FIG. 4 is an illustration showing how sensors collect spatial information that is later used to determine the string's position.

Turning now to FIG. 4, an optional configuration for detecting string deflection is depicted. There is provided a side view of two sensors, wherein the sensors are perpendicular to the string longitude axis. The two sensors 409, 410 comprise each a matrix or line sensor at the bottom with a plurality of photo-sensitive cells 413, each representing a pixel. Each sensor 409, 410 is fitted into an opaque housing which has a narrow aperture opening 403, 404 at the top. When a string is at position 402, its image is projected through aperture 403 on pixel 405 in sensor 409 and through aperture 404 on pixel 407 in sensor 410. The position of the string on the vertical axis 414 and horizontal axis 415 may be determined by triangulating angles 411 and 412. Any vertical string deflection as well as horizontal deflection may be determined by triangulating the arrival angles of the image projected through the apertures 403 and 404 on the pixels of both sensors. For example, an image projected on pixel 406 in sensor 409 and on pixel 408 in sensor 410 uniquely corresponds to string position 401.

According to some embodiments of the invention, a calibration algorithm will detect the strings, determine the characteristics of the string instrument, and determine optimal parameters for real-time data collection by the sensors, so that it will eliminate the need to address the full image at each and every frame. Instead, small elements (at least some) of the image may be addressed at each frame during real-time operation.

According to other embodiments of the present invention the use of the disclosed system with an audio signal output of the wave form in analog or digital format to an external music system or amplifier may serve as a replacement for the current string instrument pickups.

According to other embodiments of the present invention, the integration of both video sensors and optical/electromagnetic pick-up sensors may be used for achieving a combined effect.

According to some embodiments of the invention, the invention may include a self illuminating light source canceling the dependency upon sufficient light conditions for the optical sensors. One possibility is to illuminate the relevant surfaces with infra-red (or other band) lighting in conjunction with a filter (passing only that band) or polarizer (passing only wanted polarization) attached to the at least one sensor to filter out other visible light. In this method the disruptive effect of external lighting can be diminished or eliminated. Another possibility is the simple illumination of the relevant surfaces with strong visible light (such as LED lights), in order to diminish the disruptive effect of external lighting.

According to some embodiments of the invention, as part of the analysis to determine the actual performer actions, historic data will be stored and decisions will be made based on temporal characteristics of performer actions. For instance, picking timing may be determined by detecting the pulling of a string during the picking action, and then the subsequent release of the string. In this manner, picking can be distinguished from normal vibration of a string. Another function is the over time recording, analysis, storing and re-producing of performer-specific style (identifying known fretting behavior pattern, storing patterns of individuals).

According to some embodiments of the invention, a logic engine will be used for each of the data collection methods described above and determine the actual performer actions. Also, a logic data fusion engine will be used to fuse data from one or more of the data collection by the methods described herein, and further determine the actual performer actions. These logic engines may be of neural-network type, state-machine, table-based or other. The fusing together of more than one sampling method may contribute to a synergetic effect of the methods, one that will eliminate the flaws of each method and any ambiguities that may arise. Such logic engines will also store historic data and make decisions based on temporal characteristics of performer actions.

According to some embodiments of the invention, performer's actions may be detected from string deflections, positions and angles, describing the spatial and temporal characteristics of the string movement. Such actions may include hammering, slapping, slides, bends, string damping, finger vibrato, muting, harmonics etc.

According to some embodiments of the invention, a real-time calibration process may be used to compensate for changing environmental conditions, like changing external lighting. Such a process will sample external conditions and reset parameters in the real-time processes to accommodate for changing conditions.

According to some embodiments of the invention, in addition, performer's actions may include new, innovative playing techniques that may be performed on the string instrument and detected by the system according to the invention. These may include the fretting techniques in which strings are depressed to the desired frets to produce desired sounds with no need for picking, and in which strings are released to end notes, and extended sound techniques, in which sound length (sustain) can be extended indefinitely or until a string is released by the performer.

According to some embodiments of the invention, instance of picking, style and picking position (i.e. the position along the string where the picking took place), amplitude and velocity can be determined by extracting finger/pick positions from string deflection data in real-time.

According to some embodiments of the invention, fretting position may be determined by the real-time sampling of predefined (in the calibration process) sampling areas and/or points on the fret-board 120. When frequently sampling these areas and/or points in the image and comparing them to their state at rest (during calibration), one can continuously determine where (at which fret) fretting took place on each string.

According to some embodiments of the invention, fretting position may be determined by detection in real-time of the positions of the performer fingers on and in proximity to the fret-board. Finger kinematics and constraints can be used to further assist in determining the actual finger placement.

According to some embodiments of the invention, a detachable mechanism for attaching and setting the system on the stringed instrument can be used. This mechanism allows for the detaching of the system from the stringed instrument for purpose of fitting the instrument in its carrying case. The said mechanism allows for the re-connection of the system with minimal recalibration requirements. This mechanism may include a fixed element (which is permanently attached to the guitar and features a low profile) and a removable element which attaches to the fixed element.

According to some embodiments of the invention, a non permanent mechanism for attaching the device (or fixed element) to the instrument can be used. Such mechanism will allow placing the system on a guitar and later on removing it without leaving mark or damage to the guitar surface. This may be achieved by the use of non-permanent adhesives, electrostatic adhesion principal, micro-suction elements, suction-cups, or a clamp.

According to some embodiments of the invention, pitch detection techniques may be used, through data collected from the sensors. When detecting string positions at high rates, the string vibration frequency may also be detected. The auxiliary use of pitch detection may serve to augment other methods and may serve to receive feedback as to the quality of past decisions and for calibration and recalibration. It may also serve as a major process in pitch determination in some cases (mainly for higher pitch notes, where subsequent delays will be negligible).

According to other embodiments of the invention, a lighting system as described above may be provided with time modulation, in order to provide better separation from external lighting and in order to provide higher image sampling rates and better sampling quality.

According to other embodiments of the invention is the use of electromagnetic, mechanical or optical pick-up sensors. When using these sensors, both dynamic and static characteristics of the strings can be collected over time.

According to other embodiments of the present invention an optical system including mirrors and/or lenses may be used to enable viewing of multiple areas (110-160) of the instrument and for changing the optical path for detection by the sensors. The optical system may include regular, conclave or concave mirrors and/or lenses.

According to other embodiments of the present invention, the placement of the sensor and/or optical system may be in such manner that will allow the viewing of the strings from underneath the strings and/or from above the strings.

According to other embodiments of the present invention, analysis of the performer's actions will allow for different levels of proficiency of the performer. Thus, for a novice performer the method and system will become lenient and tolerant to mistakes and a non-perfect playing technique. In these instances, the logic data fusion engine will give different weight adjustments for the different inputs.

Another embodiment of the present invention is the integration of the system according to the present invention into the body of a string instrument.

While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents. Therefore, it is to be understood that alternatives, modifications, and variations of the present invention are to be construed as being within the scope and spirit of the appended claims.

What is claimed is:

1. A method for producing a signal from data collected by at least one sensor coupled to a string instrument, said method comprising the steps of:

(a) detecting in real time the string deflection of at least one string of said string instrument;

(b) analyzing said string deflection in accordance with string state calibration and predefined parameters to determine the performer's actions, wherein at least some of said analysis takes place before a sound is actually generated on the string instrument;

(c) producing a signal representing sound characteristics of the performer's actions in accordance with said analysis, wherein said string deflection is at least one of the following: vertical string deflection, horizontal string deflection, wherein said vertical string deflection over time of each string is used to determine the selected fret position for each string, and in which said horizontal string deflection over time of each string is used to determine the bending position and picking characteristics for each string.

2. The method according to claim 1, wherein data regarding string deflection is stored over a predefined period of time and wherein said stored data is used together with the real time string deflection data in said analysis.

3. A system that generates a signal in accordance with data relating to a fret position of a string in a string instrument, the system comprising:

a sensor coupled to the string instrument; and a control unit associated with the sensor;

wherein the sensor collects data relating to vertical deflection of the string, which is a deflection directed perpendicularly to the fret board, wherein the control unit processes the data relating to vertical deflection of the string to determine a fret position of the string, and generates a signal corresponding to the determined fret position.

4. The system of claim 3, wherein the sensor is photosensitive.

5. The system according to claim 4, wherein said sensor is an optical sensor comprising a plurality of photo-sensitive cells each representing a single pixel.

6. The system according to claim 5, wherein said photosensitive cells are implemented with at least one of the following technologies: Charge Coupled Devices (CCD), Complementary Metal Oxide Silicon (CMOS), photo diode array.

7. The system according to claim 5, wherein said photosensitive cells are arranged in at least one of the following manner: one-dimensional cells array, two-dimensional cells array, matrix, cluster.

8. The system according to claim 5, wherein said sensors are adapted to collect data from different angles corresponding to the same string and wherein said data from different angles enables a triangulation process in which the string deflection is determined.

9. The system according to claim 5, further comprising a self illuminating source having at least one of the following features: a specific wavelength, a narrow bandwidth, modulation, corresponding filters.

10. The system according to claim 4, wherein said sensor is fitted into a pickup enclosure.

11. The system according to claim 3, wherein said signal enables the control of at least one of the following: synthesizers, sequencers, drum machines, lighting, computers, gaming consoles.

12. The system according to claim 3, further enabling the auxiliary use of pitch detection techniques for the purpose of calibration and feedback.

13. The system according to claim 3, wherein the system is integrated into a common string instrument.

14. A system for generating a signal from data relating to the position of the strings in a string instrument, said data collected by at least one sensor directed at said strings, said system comprising:

at least one sensor coupled to a string instrument wherein said sensor is directed at said strings;

a control unit associated with said at least one sensor;

wherein said at least one sensor is adapted to collect said data that comprises the string deflection of at least one said string at any given time and wherein said control unit is adapted to process said data and generate a signal corresponding to the said data, wherein said sensor is an optical sensor comprising a plurality of photo-sensitive cells each representing a single pixel, wherein said photo-sensitive cells are fitted into at least one opaque housing having a narrow aperture opening of at least one of the following kind: slit, pin-hole.

15. A method of producing a signal that represents sound characteristics using a string instrument having a fret-board, the method comprising:

detecting a vertical string deflection of a string of said string instrument, wherein vertical deflection is a deflection in direction perpendicular to the fret-board;

analyzing the detected vertical string deflection to determine a fretting position; and producing a signal representing sound characteristics in accordance with the determined fret position.

16. The method of claim 15, wherein detecting comprises detecting with a photosensitive sensor.

17. A method according to claim 15, comprising:

tracing vertical string deflection of each string of the string instrument over time; and determining, from the traced deflections, a selected fret position for each string.

* * * * *